US010143897B2

(12) United States Patent
Rosenkranz et al.

(10) Patent No.: US 10,143,897 B2
(45) Date of Patent: Dec. 4, 2018

(54) BRIDGE FOR A BALL GAME RACKET

(71) Applicant: Head Technology GmbH, Kennelbach (AT)

(72) Inventors: Harald Rosenkranz, Lauterach (AT); Wolfgang Schlor, Hard (AT); Daniel Lau, Dornbirn (AT); Stefan Mohr, Dornbirn (AT); Ralf Schwenger, Weiler-Simmerberg (DE)

(73) Assignee: Head Technology GmbH, Kennelbach (AT)

( * ) Notice: Subject to any disclaimer, the term of this patent is extended or adjusted under 35 U.S.C. 154(b) by 0 days.

(21) Appl. No.: 15/587,716

(22) Filed: May 5, 2017

(65) Prior Publication Data

US 2017/0319911 A1 Nov. 9, 2017

(30) Foreign Application Priority Data

May 6, 2016 (EP) ..... 16168583

(51) Int. Cl.

| | |
|---|---|
| ***A63B 49/02*** | (2015.01) |
| ***A63B 49/022*** | (2015.01) |
| ***A63B 60/52*** | (2015.01) |
| ***A63B 49/03*** | (2015.01) |
| *A63B 49/028* | (2015.01) |

(52) U.S. Cl.

CPC ..... *A63B 49/02* (2013.01); *A63B 49/022* (2015.10); *A63B 49/03* (2015.10); *A63B 60/52* (2015.10); *A63B 49/028* (2015.10)

(58) Field of Classification Search

CPC ..... A63B 49/02; A63B 49/03; A63B 49/022; A63B 49/028; A63B 60/50; A63B 60/52

USPC ..... D21/729–732, 753

See application file for complete search history.

(56) References Cited

U.S. PATENT DOCUMENTS

| | | | | | |
|---|---|---|---|---|---|
| 3,908,995 | A | * | 9/1975 | Portz | A63B 49/022 473/539 |
| 4,138,109 | A | * | 2/1979 | Nobbs | A63B 49/03 473/539 |
| D253,713 | S | * | 12/1979 | Robinson | 473/546 |
| D286,902 | S | * | 11/1986 | Tilley | D21/730 |
| 4,798,382 | A | * | 1/1989 | Janes | A63B 49/02 473/535 |
| 4,828,259 | A | * | 5/1989 | Davis | A63B 60/54 473/522 |
| 4,889,338 | A | * | 12/1989 | Keijiro | A63B 49/00 428/905 |
| 5,060,944 | A | * | 10/1991 | Janes | A63B 49/03 473/539 |
| 5,137,273 | A | * | 8/1992 | Jseng | A63B 49/022 473/543 |
| 5,141,228 | A | * | 8/1992 | Soong | A63B 49/025 473/521 |
| D367,904 | S | * | 3/1996 | Hodges | D21/730 |

(Continued)

FOREIGN PATENT DOCUMENTS

| | | |
|---|---|---|
| DE | 28 12 647 A1 | 9/1979 |
| DE | 10 2007 056 831 A1 | 5/2009 |

(Continued)

*Primary Examiner* — Raleigh W Chiu

(74) *Attorney, Agent, or Firm* — Bookoff McAndrews, PLLC

(57) ABSTRACT

The invention relates to a bridge for a ball game racket as well as to a frame for a ball game racket comprising a bridge.

23 Claims, 7 Drawing Sheets

(56) References Cited

U.S. PATENT DOCUMENTS

| | | | | |
|---|---|---|---|---|
| 5,702,313 | A * | 12/1997 | Stennett | A63B 51/00 473/539 |
| 6,319,158 | B1 * | 11/2001 | Cheng | A63B 49/00 473/522 |
| 6,811,502 | B1 * | 11/2004 | Janes | A63B 49/022 473/521 |
| 7,309,299 | B2 * | 12/2007 | Pezzato | A63B 49/11 473/524 |
| 7,396,303 | B2 * | 7/2008 | Gazzara | A63B 51/00 473/539 |
| 7,431,673 | B2 * | 10/2008 | Niwa | A63B 51/00 473/524 |
| 8,002,651 | B2 * | 8/2011 | Babolat | A63B 49/038 473/524 |
| D689,573 | S * | 9/2013 | Severa | D21/730 |
| 8,608,596 | B1 * | 12/2013 | Chang | A63B 49/028 473/546 |
| 2007/0123377 | A1 * | 5/2007 | Gazzara | A63B 51/00 473/540 |
| 2007/0135245 | A1 * | 6/2007 | Gazzara | A63B 49/002 473/524 |
| 2010/0048333 | A1 * | 2/2010 | Cottey | A63B 49/02 473/521 |
| 2011/0201461 | A1 * | 8/2011 | Gazzara | A63B 59/48 473/527 |
| 2017/0319912 | A1 * | 11/2017 | Lau | A63B 49/02 |

FOREIGN PATENT DOCUMENTS

| | | |
|---|---|---|
| EP | 1 473 063 A2 | 11/2004 |
| GB | 2 056 288 A | 3/1981 |

* cited by examiner

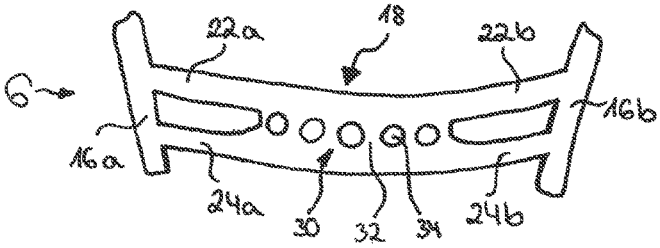
Fig. 5A
Fig. 5B
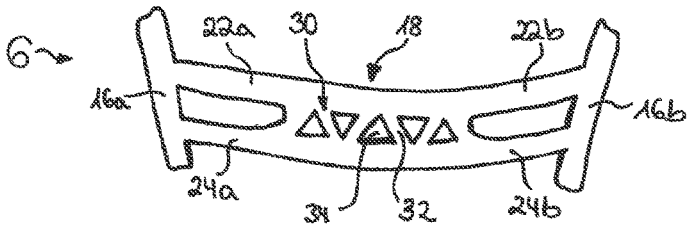
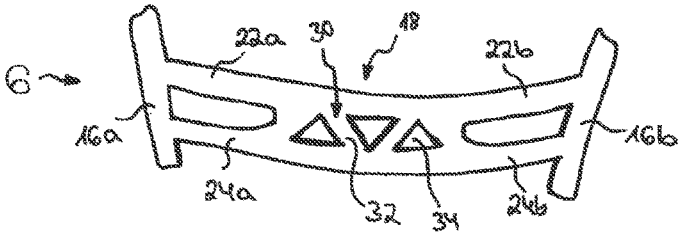
Fig. 5C
Fig. 5D
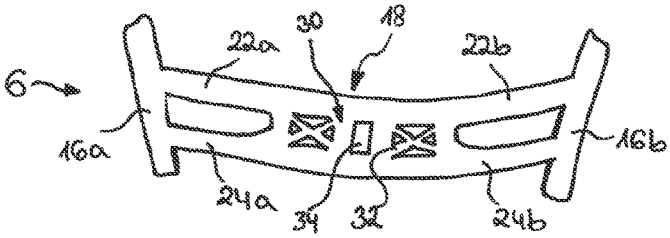

BRIDGE FOR A BALL GAME RACKET

This patent application claims the benefit under 35 U.S.C. § 119 to European Patent Application No. 16 16 8583.9, filed on May 6, 2016, the entirety of which is incorporated herein by reference.

The present invention relates to a bridge for a ball game racket as well as to a ball game racket comprising the bridge according to the invention.

Racket frames for ball game rackets normally have a handle region, a racket head and a heart region arranged therebetween, wherein the heart region is formed by two frame bars extending from the handle region and a bridge. The bridge has several functions which are essential to the playing or handling behavior of the ball game racket. On the one hand, the bridge as a rule receives a plurality of longitudinal strings of the stringing and thus influences the behavior of the stringing. In particular, for geometrical reasons these strings are the central longitudinal strings which extend through the so-called "sweet spot" and thus have a decisive influence on the feeling sensed by the player during playing. Moreover, the bridge closes the racket head to a ring-shaped structure, which has a decisive influence on the deformability of the racket head. Furthermore, the bridge also stabilizes the two frame bars and thus influences the overall stability of the frame of the ball game racket.

Against this background, there have already been many attempts to optimize the bridge of a ball game racket in view of various properties. For example, DE 10 2007 056 831 A1 suggests a bridge having a hinge by means of which the deformation behavior of the racket can be adjusted in a well-aimed and controlled manner. A similar attempt is made in DE 28 12 647, which discloses a heart piece which can be elastically deflected perpendicularly with respect to the racket plane. U.S. Pat. No. 4,828,259 discloses a double bridge with a dampening material.

Nevertheless, there is still need for a further optimization of the bridge of a frame of a ball game racket in view of its mechanical demands. This object is achieved by a bridge according to claim 1. Preferred embodiments of the bridge according to the invention (as well as of the ball game racket according to the invention comprising the bridge according to the invention) are described in the dependent claims as well as in the aspects.

Accordingly, the invention is directed to a bridge for a ball game racket, wherein the bridge comprises a central region and two edge regions intended for being connected to the frame of a ball game racket. From both sides of the central region at least one lower web or ligament and at least two upper webs or ligaments respectively extend to the two edge regions. The central region comprises first through openings for receiving longitudinal strings. At least two further through openings for receiving longitudinal strings are arranged in such a manner that the longitudinal strings to be received therein each extend between the corresponding two upper webs.

The directions "lower/bottom" and "upper/top" relate to the orientation of the bridge in the mounted state, i.e. when the bridge is connected to the remaining frame of a ball game racket, wherein the ball game racket is oriented in such a manner that the handle region is at the bottom and the racket head at the top. In other words, the two lower webs are on the side of the bridge facing the handle region and the four upper webs on the side of the bridge facing the head region.

The central region, together with the two lower webs, preferably has the function of a regular bridge, wherein in particular the central region comprises through openings for receiving longitudinal strings and is preferably configured for redirecting one or more longitudinal strings in the area of the central region. Preferably, also the two lower webs each comprise through openings for receiving longitudinal strings, wherein the longitudinal strings do not necessarily have to be redirected in the area of the lower webs. Rather, it is also possible that one or more longitudinal strings are passed through one of the lower webs and up to the corresponding frame bars of the frame of the ball game racket. The at least four upper webs preferably do not serve for receiving or redirecting strings but rather for stabilizing the bridge since they are connected farther to the top of the racket head. If a regular bridge were connected in a similar region of the racket head, this would disadvantageously shorten the longitudinal strings. The connection of the bridge to the racket frame by means of the four upper webs and the two lower webs at the same time allows on the one hand a good force transmission of the forces acting on the bridge into the racket head and on the other hand an excellent stabilization against torsional deformation. In this connection it is preferable that the bridge is substantially mirror symmetrical, wherein in the mounted state of the bridge the stringing plane formed by the stringing acts as the corresponding mirror surface.

The bridge is preferably configured such that the longitudinal strings to be received by the at least two second through openings each extend in a contactless manner between the corresponding two upper webs. This guarantees that the bridge is held in a correspondingly stable manner at the racket head by the four upper webs, without the string length of the longitudinal strings being disadvantageously shortened. However, also embodiments in which a dampening material is provided between the two upper webs are possible. In other words, the longitudinal strings are received by the central region and optionally by the two lower webs, but the strings can also be indirectly in contact with the four upper webs, for example by way of a dampening element.

The webs are preferably geometrically separate elements which are preferably spaced apart from each other. It is preferred that between the central region and the corresponding edge region, the lower web is not connected to any of the two upper webs. Moreover, the two upper webs are preferably not connected to each other between the central region and the corresponding edge region. Preferably, the distance between the two upper webs is, at least in sections, at least 5 mm, preferably at least 10 mm and particularly preferably at least 15 mm, wherein the distance means the distance between two opposing outer surfaces of the webs, measured perpendicularly with respect to the stringing plane. In other words, the distance between the webs corresponds to the expansion of the gap between the two webs.

Furthermore, it is preferred that the projection of the distance between one of the upper webs and the lower web onto the stringing plane formed by the stringing is, at least in sections, at least 5 mm, preferably at least 10 mm and particularly preferably at least 15 mm. Also this distance is understood to be the distance between the opposing outer surfaces of the respective webs and thus relates to the dimensions of the gap between neighboring webs (projected onto the stringing plane). In other words, a through opening is respectively formed between the two upper webs and the lower web, which appears as through opening when the viewing direction is perpendicular with respect to the stringing plane. The visible cross-sectional area of this through opening is preferably at least 1.5 $cm^2$, more preferably at least 2 $cm^2$ and particularly preferably at least 2.5 $cm^2$. The web structure does not only render the bridge as a whole lighter, but it also has a less solid appearance because of the through openings that are formed between the webs and, therefore, leads to a particularly esthetical overall appearance. Moreover, the through openings are also advantageous in view of aerodynamics.

In order to keep the extensions of the central region of the bridge as small as possible but on the other hand allow the upper webs to be connected as close to the top of the racket head as possible, it is preferred that the distance between one of the two upper webs and the lower web increases continuously from the central region to the corresponding edge region. It is also preferred that the distance between the two upper webs increases from the central region to the corresponding edge region in order to design the central region of the bridge as narrow as possible but on the other hand allow a connection of the two upper webs in the area of the outer sides of the frame region forming the racket head.

Basically, the two edge regions of the bridge can be formed by the outer ends of the webs, wherein the outer ends of the webs of both edge regions can be connected with each other or can be separated from each other. The edge regions of the bridge or these outer web ends can then be connected to the remaining frame of the ball game racket in any desired manner, for example by screwing, welding, bonding, etc. However, particularly preferably respective brackets are provided at the two edge regions, said brackets being suitable for connecting the bridge to a racket frame in an area that is as large as possible. Particularly preferably, these brackets are configured such that they allow a connection to a racket frame that is to be made by using the blow tube molding. In this connection it is preferable that the brackets each have a concave outer surface. Moreover, it is preferred that the brackets have an outer surface which is preferably at least 10 $cm^2$, more preferably at least 15 $cm^2$ and particularly preferably at least 20 $cm^2$. Preferably, at least one of the second through openings is respectively arranged in a corresponding one of the brackets. This allows a longitudinal string to be passed through a through opening in the bracket and a corresponding through opening in the corresponding frame bar of the ball game racket and, e.g., allows redirection of a string at the frame bar. Additionally or alternatively, the brackets can each have at least one, preferably two third through openings for receiving longitudinal and/or transverse strings. In other words, the bracket can have one or more further through openings, wherein it is not necessary that the longitudinal and/or transverse strings to be received by these through openings extend between the two upper webs.

Preferably, all webs lead on one side of the bridge into a common bracket or mounting link. However, it is also possible to provide a plurality of brackets per side, for example one bracket for the upper webs and a common bracket for the two lower webs. Alternatively, an own bracket might be provided for each web.

Since the central region is arranged centrally in the bridge and accordingly the longitudinal strings received by the central region extend through the so-called "sweet spot", the mechanical properties of this central region are essential to the playing or handling behavior of the ball game racket. Basically, this central region can be configured as a solid body having, for example, an approximately round, elliptical, rectangular or similar cross-sectional profile. However, it is preferred that the central region is groove-shaped. This allows a particularly stable bridge to be formed in lightweight construction. Moreover, such a groove-shaped structure allows an elongation of the respective longitudinal strings without any loss in view of the stability of the bridge. The sides of the groove-shaped central region can be configured as continuous side wall or as a lattice structure. The latter is particularly advantageous in view of the bridge being as lightweight as possible. The groove-shaped central region furthermore comprises two opposing edges from which the webs extend towards the edge regions of the bridge. The groove is preferably closed at these opposing edges by means of a respective end wall, so that the groove has a pot-shaped structure with four (partly interrupted) surrounding walls. Preferably, the bottom of the groove has at least two, more preferably at least three, particularly preferably at least four through openings for receiving longitudinal strings.

The extension of the central region of the bridge in a direction perpendicular with respect to the stringing plane is preferably less than 20 mm, more preferably less than 15 mm and particularly preferably less than 13 mm. The wall thickness of the continuous side wall or lattice structure of the groove is, at least in sections, preferably smaller than 5 mm, more preferably smaller than 4 mm and particularly preferably smaller than 3 mm. The extension of the central region along the longitudinal axis of the racket (i.e. from the handle region towards the head region) is, at least in sections, preferably larger than 10 mm, more preferably larger than 12 mm. The groove-shaped central region can also be divided by a partition wall into two pot-shaped regions.

The upper and/or lower webs of the bridge can be relatively filigree structures because the stability of the bridge is guaranteed, i.a., by the presence of a plurality of spaced-apart webs. For example, the cross-sectional area of the lower web and/or the upper webs is, at least in sections, preferably smaller than 50 $mm^2$, more preferably smaller than 40 $mm^2$ and particularly preferably smaller than 30 $mm^2$. Preferably, the cross-sectional area of one or more webs increases from the central region of the bridge towards the edge region of the bridge. Moreover, it is preferred that the cross-sectional area of the lower web is, at least in sections, larger than the cross-sectional area of the upper webs.

At least some of the through openings and preferably all through openings are configured to receive one single string. Hence, some and preferably all through openings preferably have a cross-sectional area of less than 5 $mm^2$, more preferably of less than 4 $mm^2$ and particularly preferably of less than 3 $mm^2$. Moreover, it is preferable that at least one of the second through openings is respectively arranged in a corresponding one of the lower webs. Preferably, at least one of the second through openings, which is arranged in one of the lower webs, extends from the upper surface of the lower web to the edge region or to the bracket of the bridge, so that a longitudinal string of the stringing can be passed through the lower web and through a frame bar of the racket frame.

In a preferred embodiment of the present invention, on both sides of the central region of the bridge two lower webs respectively extend to the two edge regions. In this embodiment it is preferred that the longitudinal strings to be received by the second through openings each extend between the corresponding two lower webs. Preferably, in this case the second through openings are provided in the brackets of the bridge.

Preferably, the bridge according to the invention is formed as one part. Moreover, the bridge according to the invention is preferably a cast metal part, more preferably an injection molded metal part. Basically, different light metals such as aluminum, aluminum alloys, titanium or titanium alloys are suitable for this purpose. However, it is particularly preferred that the bridge is made from a magnesium alloy. For example, by means of suitable magnesium alloys (e.g. SAE SiC/AZ91), particularly stable bridges can be manufactured, which can at the same time be extremely light-weight. Preferably, the overall weight of the bridge according to the invention is less than 35 g, more preferably less than 30 g and particularly preferably less than 25 g.

The present invention is further directed to a ball game racket having a racket frame which comprises a handle region, a racket head and a heart region arranged therebetween, the heart region being formed by two frame bars extending from the handle and a bridge as described above. The ball game racket preferably comprises a stringing formed by longitudinal and transverse strings, wherein at least one first longitudinal string is passed through a through opening in the central region of the bridge, and at least one respective second longitudinal string is passed through a through opening of the two lower webs of the bridge. The two second longitudinal strings each preferably extend between the corresponding two upper webs of the bridge. The racket frame is preferably formed as a hollow profile made of carbon fiber and is integrally formed with the bridge.

According to an alternative preferred embodiment, the two further second through openings do not necessarily have to be provided in the bridge (for example in the brackets). Rather, the respective longitudinal strings can also be received directly by through openings in the frame bar of the ball game racket. Hence, the present invention is also directed to a ball game racket having a racket frame which comprises a handle region, a racket head and a heart region arranged therebetween, the heart region being formed by two frame bars extending from the handle region and a bridge. The bridge has a central region and two edge regions being connected to the frame of the ball game racket. From both sides of the central region at least one lower web and at least two upper webs respectively extend to the two edge regions. The central region has first through openings for receiving longitudinal strings. Moreover, at least two further second through openings are arranged in the two frame bars for receiving longitudinal strings in such a manner that the longitudinal strings to be received therein each extend between the corresponding two upper webs.

In accordance with the invention, all preferred embodiments discussed above can also be used in this alternative embodiment. In particular, in this embodiment it is preferred that from both sides of the central region two lower webs respectively extend to the two edge regions. Preferably, the longitudinal strings to be received by the second through openings then also extend between the corresponding two lower webs.

The present invention relates in particular also to the following aspects:

1. A bridge for a ball game racket, wherein the bridge comprises a central region and two edge regions which are intended for being connected to the frame of a ball game racket, wherein from both sides of the central region a lower web or ligament and two upper webs or ligaments respectively extend to the two edge regions, wherein the central region comprises first through openings for receiving longitudinal strings and wherein at least two further second through openings are arranged for receiving longitudinal strings in such a manner that the longitudinal strings to be received therein each extend between the corresponding two upper webs.
2. The bridge according to aspect 1, wherein the longitudinal strings to be received by the at least two second through openings each extend in a contactless manner between the corresponding two upper webs.
3. The bridge according to aspect 1 or 2, wherein the respective lower web is not connected to any of the two upper webs between the central region and the corresponding edge region.
4. The bridge according to any of the preceding aspects, wherein the respective two upper webs are not connected with each other between the central region and the corresponding edge region.
5. The bridge according to any of the preceding aspects, wherein the respective distance between the two upper webs increases from the central region towards the corresponding edge region.
6. The bridge according to any of the preceding aspects, wherein a through opening is respectively formed between the two upper webs and the lower web perpendicularly with respect to a plane defined by the stringing, the cross-sectional area of said plane being preferably at least 1.5 $cm^2$, more preferably at least 2 $cm^2$ and particularly preferably at least 2.5 $cm^2$.
7. The bridge according to any of the preceding aspects, wherein the two edge regions each comprise brackets or mounting links which are suitable for connecting the bridge to a racket frame to be made by using the blow tube molding.
8. The bridge according to aspect 7, wherein the brackets each have a concave outer surface which is preferably at least 10 $cm^2$, more preferably at least 15 $cm^2$ and particularly preferably at least 20 $cm^2$.
9. The bridge according to aspect 7 or 8, wherein at least one of the second through openings is respectively arranged in a corresponding one of the brackets.
10. The bridge according to aspect 7, 8 or 9, wherein the brackets each have at least one, preferably two third through opening(s) for receiving longitudinal and/or transverse strings.
11. The bridge according to any of the preceding aspects, wherein the central region is groove-shaped and wherein the sides of the groove are each configured as continuous side wall or as a lattice structure.
12. The bridge according to aspect 11, wherein the groove has opposing edges from which the webs extend to the edge regions, and wherein the groove is closed at said opposing edges by means of a respective end wall.
13. The bridge according to aspect 11 or 12, wherein the bottom of the groove comprises at least two, preferably at least four through openings for receiving longitudinal strings.
14. The bridge according to any of the preceding aspects, wherein at least some, preferably all through openings are configured for receiving one single string each.
15. The bridge according to any of the preceding aspects, wherein at least one of the second through openings is respectively arranged in a corresponding one of the lower webs.
16. The bridge according to any of the preceding aspects, wherein from both sides of the central region two lower webs respectively extend to the two edge regions.

17. The bridge according to aspect 16, wherein the longitudinal strings to be received by the second through openings each extend between the corresponding two lower webs.
18. The bridge according to any of the preceding aspects, wherein the bridge is formed as cast metal part, preferably as injection molded metal part.
19. A ball game racket having a racket frame which comprises a handle region, a racket head and a heart region arranged therebetween, the heart region being formed by two frame bars extending from the handle and a bridge according to any of the preceding aspects.
20. The ball game racket according to aspect 19, further comprising a stringing formed by longitudinal and transverse strings, wherein at least one first longitudinal string is passed through a through opening in the central region of the bridge and at least one second longitudinal string is passed through a respective through opening of the two lower webs of the bridge, and wherein the two second longitudinal strings each extend between the corresponding two upper webs of the bridge.
21. The ball game racket according to aspect 19 or 20, wherein the racket frame is formed as a hollow profile made of carbon fiber and is integrally formed with the bridge.
22. A ball game racket having a racket frame which comprises a handle region, a racket head and a heart region arranged therebetween, the heart region being formed by two frame bars extending from the handle region and a bridge, wherein the bridge has a central region and two edge regions being connected to the frame of the ball game racket, wherein from both sides of the central region a lower web and two upper webs respectively extend to the two edge regions, wherein the central region has first through openings for receiving longitudinal strings and wherein at least two further second through openings are arranged in the two frame bars for receiving longitudinal strings in such a manner that the longitudinal strings to be received therein each extend between the corresponding two upper webs.
23. The ball game racket according to aspect 22, wherein the longitudinal strings to be received by the at least two second through openings each extend in a contactless manner between the corresponding two upper webs.
24. The ball game racket according to aspect 22 or 23, wherein the respective lower web is not connected to any of the two upper webs between the central region and the corresponding edge region.
25. The ball game racket according to any of aspects 21 to 24, wherein the respective two upper webs are not connected with each other between the central region and the corresponding edge region.
26. The ball game racket according to any of aspects 21 to 25, wherein the respective distance between the two upper webs increases from the central region towards the corresponding edge region.
27. The ball game racket according to any of aspects 21 to 26, wherein a through opening is respectively formed between the two upper webs and the lower web perpendicularly with respect to a plane defined by the stringing, the cross-sectional area of said plane being preferably at least 1.5 $cm^2$, more preferably at least 2 $cm^2$ and particularly preferably at least 2.5 $cm^2$.
28. The ball game racket according to any of the preceding aspects, wherein the two edge regions each comprise brackets which are suitable for connecting the bridge to the frame of the ball game racket which is preferably made by using the blow tube molding.
29. The ball game racket according to aspect 28, wherein the brackets each have a concave outer surface which is preferably at least 10 $cm^2$, more preferably at least 15 $cm^2$ and particularly preferably at least 20 $cm^2$.
30. The ball game racket according to aspect 28 or 29, wherein at least one of the second through openings is respectively arranged in a corresponding one of the brackets.
31. The ball game racket according to aspect 28, 29 or 30, wherein the brackets each have at least one, preferably two third through opening(s) for receiving longitudinal and/or transverse strings.
32. The ball game racket according to any of aspects 21 to 31, wherein the central region is groove-shaped and wherein the sides of the groove are each configured as continuous side wall or as a lattice structure.
33. The ball game racket according to aspect 32, wherein the groove has opposing edges from which the webs extend to the edge regions, and wherein the groove is closed at said opposing edges by means of a respective end wall.
34. The ball game racket according to aspect 32 or 33, wherein the bottom of the groove comprises at least two, preferably at least four through openings for receiving longitudinal strings.
35. The ball game racket according to any of aspects 21 to 34, wherein at least some, preferably all through openings are configured for receiving one single string each.
36. The ball game racket according to any of aspects 21 to 35, wherein at least one of the second through openings is respectively arranged in a corresponding one of the lower webs.
37. The ball game racket according to any of aspects 21 to 36, wherein from both sides of the central region two lower webs respectively extend to the two edge regions.
38. The ball game racket according to aspect 37, wherein the longitudinal strings to be received by the second through openings each extend between the corresponding two lower webs.
39. The ball game racket according to any of aspects 21 to 38, wherein the bridge is formed as cast metal part, preferably as injection molded metal part.
40. The ball game racket according to any of aspects 21 to 39, further comprising a stringing formed by longitudinal and transverse strings, wherein at least one first longitudinal string is passed through a through opening in the central region of the bridge and at least one second longitudinal string is passed through a respective through opening of the two lower webs of the bridge, and wherein the two second longitudinal strings each extend between the corresponding two upper webs of the bridge.
41. The ball game racket according to any of aspects 21 to 40, wherein the racket frame is formed as a hollow profile made of carbon fiber and is integrally formed with the bridge.

In the following, preferred embodiments of the bridge according to the invention and the frame according to the invention are described in more detail on the basis of the Figures in which FIG. 1 shows a schematic front view of a frame according to the invention in accordance with a preferred embodiment;

Figure 1:
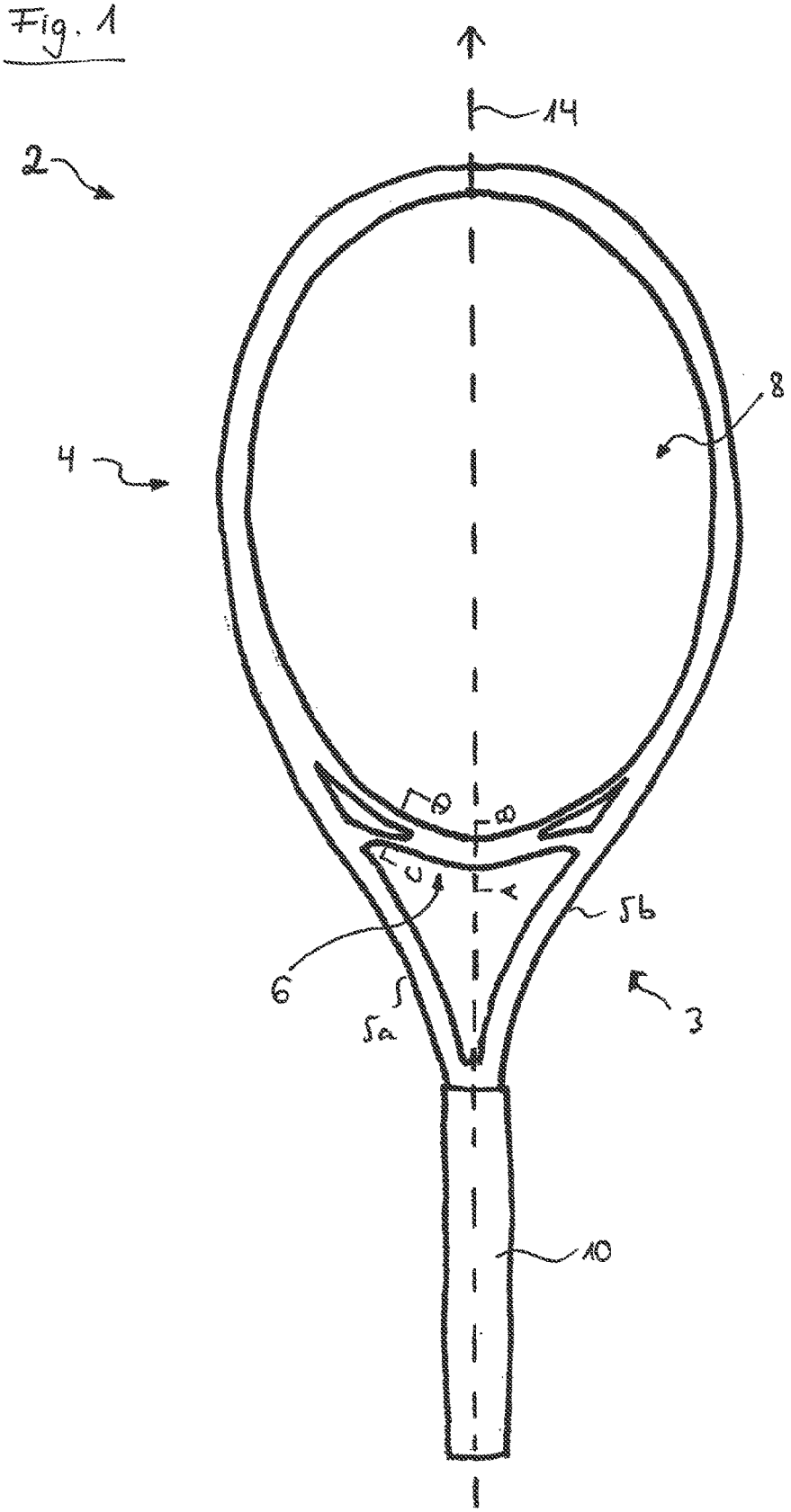
Figure 6A:
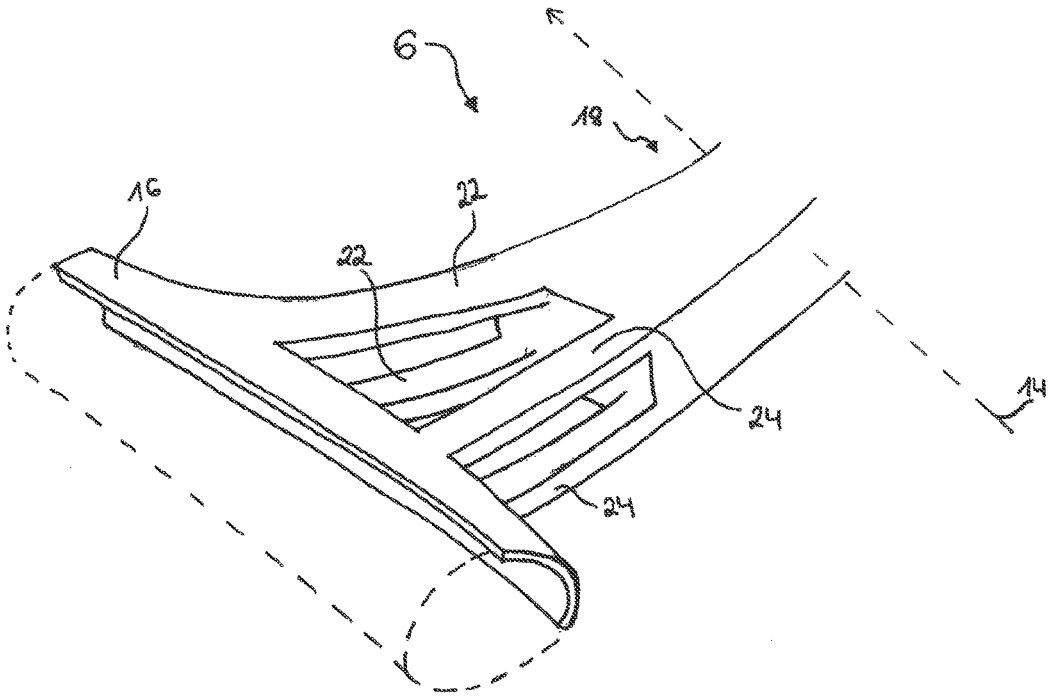
Figure 6B:
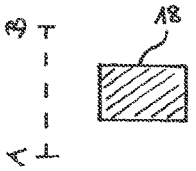
Figure 6C:
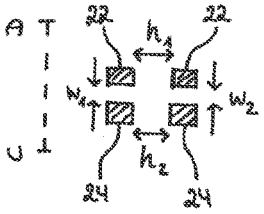
Figure 6D:
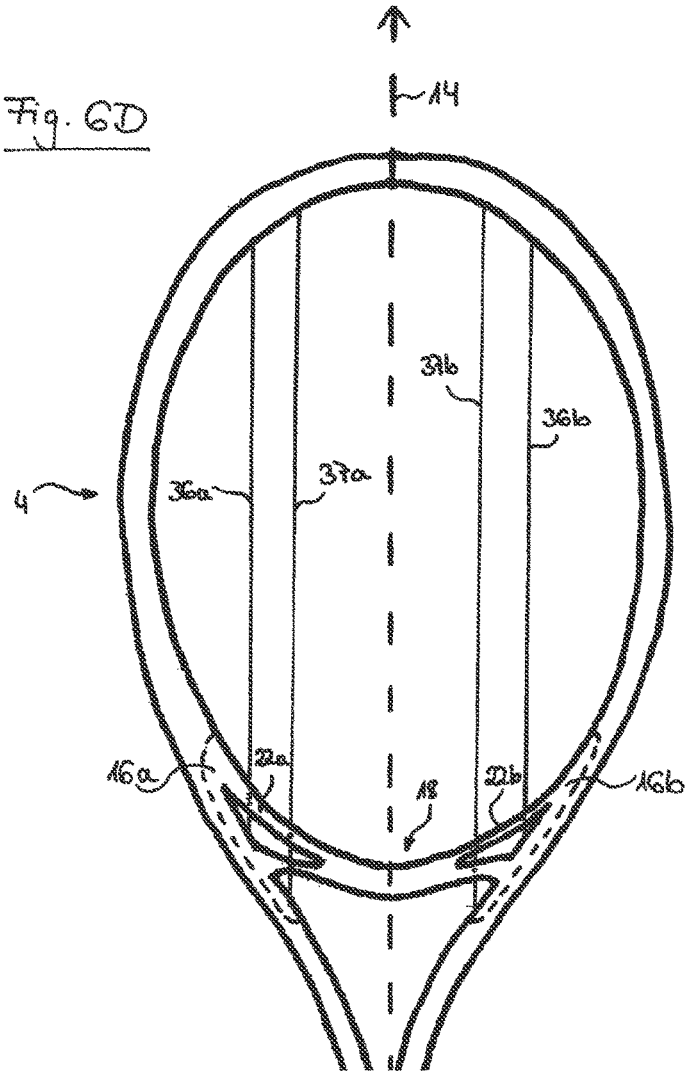
Figure 6E:
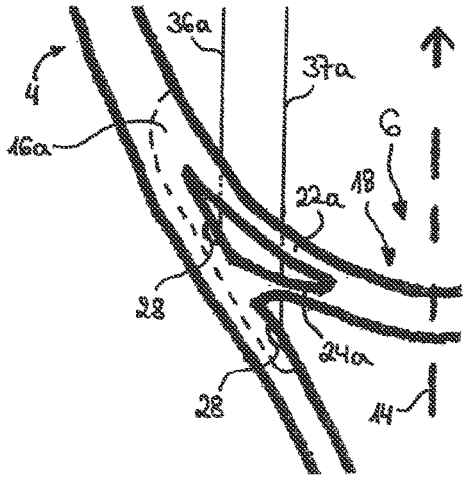

FIGS. 5A-5D each show a schematic front view of a bridge according to the invention in accordance with further preferred embodiments;

FIG. 6A shows a schematic perspective partial view of a bridge according to the invention in accordance with a further preferred embodiment;

FIG. 6B shows a schematic view of a cross-section of the bridge of FIG. 6A through the line A-B according to FIG. 1;

FIG. 6C shows a schematic view of a cross-section of the bridge of FIG. 6A through the line C-D according to FIG. 1;

FIG. 6D shows a schematic front view of a section of a frame according to the invention in accordance with a further preferred embodiment with the bridge of FIG. 6A; and FIG. 6E shows an enlarged section of FIG. 6D.

FIG. 1 shows a schematic front view of a frame 2 for a ball game racket according to the present invention. The frame 2 comprises a head region or racket head 4 for receiving a stringing (not shown) and a handle region 10, the central axis of which coincides with the longitudinal axis 14 of the frame 2. A heart region 3 is arranged between the racket head 4 and the handle region 10, said heart region being formed by two frame bars 5*a*, 5*b* extending from the handle region 10 and a bridge 6. The dimensions and the shape of the frame 2 are of course understood to be exemplary. The schematic frame 2 shown in FIG. 1 can have any bridges according to the invention, for example the preferred embodiments of bridges according to the invention described in detail below.

Figure 2A:
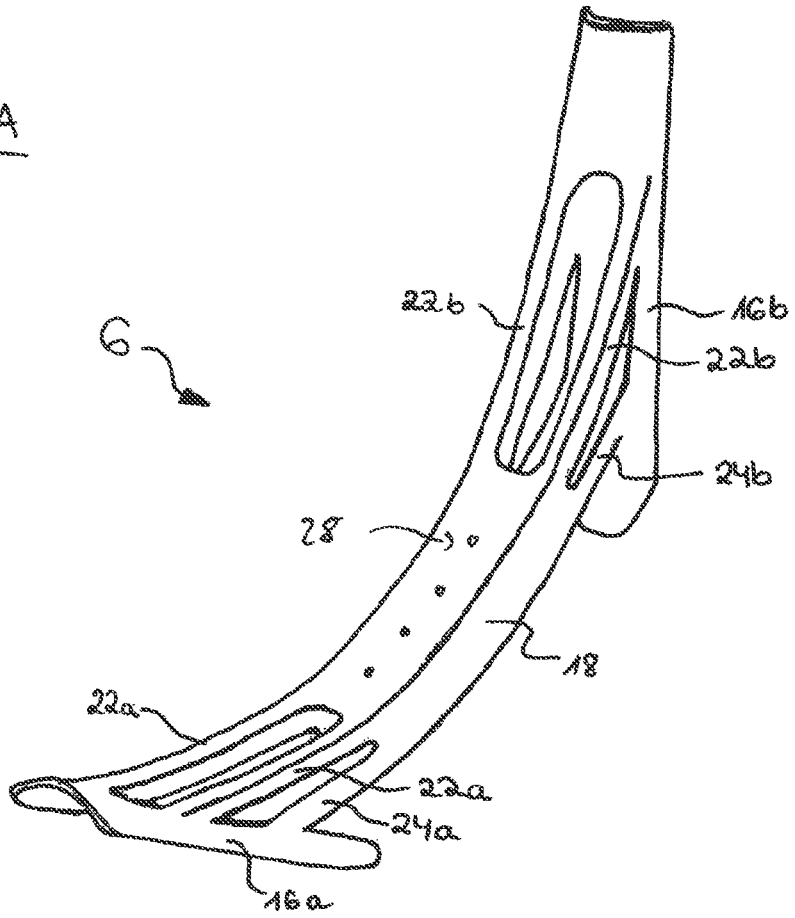
FIG. 2A shows a schematic perspective view of a bridge according to the invention in accordance with a preferred embodiment.

A preferred embodiment of a bridge 6 is shown in a perspective view in FIG. 2A. The bridge is suitable for any ball game racket, for example the ball game racket according to FIG. 1. The bridge has a central region 18 and two edge regions 16*a*, 16*b*, which are intended for being connected to the frame of a ball game racket. In the shown preferred embodiment of FIG. 2A, the two edge regions are formed by two brackets 16*a*, 16*b*, which serve for connecting the bridge 6 to the frame bar 5*a*, 5*b* and/or a part of the head region 4. The brackets 16*a*, 16*b* limit the shown bridge 6 at both ends of its directrix and preferably have concave outer surfaces, which can engage with the correspondingly shaped convex regions of the frame or can be connected thereto in a positive-locking manner.

From both sides of the central region 18 of the bridge a lower web 24*a*, 24*b* and two upper webs 22*a*, 22*b* respectively extend to the two edge regions or brackets 16*a*, 16*b*. The central region 18 has (in this case four) first through openings 28 for receiving longitudinal strings, wherein at least two further second through openings (not shown) are arranged for receiving longitudinal strings in such a manner that the longitudinal strings to be received therein each extend between the corresponding two upper webs 22*a*, 22*b*. Preferably, at least some of these second through openings are respectively provided in the lower webs 24*a*, 24*b*. Alternatively or additionally, at least some of these second through openings can be provided in brackets 16*a*, 16*b* (see also the discussion of FIGS. 6D and 6E).

Figure 2B:
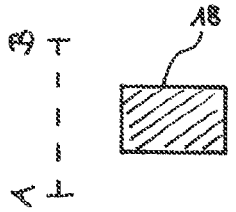
FIG. 2B shows a schematic view of a cross-section of the bridge of FIG. 2A through the line A-B according to FIG. 1.
Figure 2C:
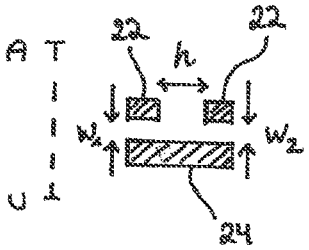
FIG. 2C shows a schematic view of a cross-section of the bridge of FIG. 2A through the line C-D according to FIG. 1.

FIG. 2B shows a cross-section of the bridge of FIG. 2A through the line A-B of FIG. 1. FIG. 2B also shows a cross-section through the central region 18 of the bridge of FIG. 2A (at a region without through opening or string opening 28). As shown in FIG. 2B, in the shown preferred embodiment the bridge comprises a central region 18 with exclusively convex cross-section, which is exemplarily shown here to be substantially rectangular. Alternatively, the cross-section can also have rounded corners or be round, elliptical or multiangular or have any other cross-sectional shape. FIG. 2C shows a cross-section of the bridge of FIG. 2A through the line C-D according to FIG. 1. FIG. 2C thus shows a cross-section through the web region of the bridge of FIG. 2A. As shown in FIG. 2C, the webs 22 and 24 of the bridge of the shown preferred embodiment also each have a convex cross-sectional profile, exemplarily also being substantially rectangular. Alternatively, the cross-section can also have rounded corners, be round, elliptical or multiangular or have any other cross-sectional shape.

As evident from the different cross-sectional shapes shown in FIGS. 2B and 2C, which are meant to be exemplary only, an aspect of the invention relates to the idea of providing a central region 18 for receiving the longitudinal strings, said central region 18 being as stable as possible, and to connect it by means of relatively filigree webs 22 and 24 (optionally by means of brackets 16*a* and 16*b*) to the remaining racket frame. As schematically shown in FIG. 1, this web structure allows the bridge to be attached relatively close to the top of the racket head 4 by means of the upper webs 22*a* and 22*b*, without disadvantageously reducing the length of the longitudinal strings, because the longitudinal strings extend between the opposing upper webs 22*a* and 22*b*. Moreover the web structure reduces the overall weight of the bridge advantageously. This advantage can also be achieved by cross-sectional profiles different from that according to FIGS. 2B and 2C. For example, it is preferred that the cross-sectional area of the lower web 24 is larger than the cross-sectional area of an upper web 22, as schematically shown in FIG. 2C. However, in a direction perpendicular with respect to the stringing plane, the lower web 24 does not have to extend as far as the two upper webs 22 (as also shown in FIG. 2C). The two upper webs 22 have a respective distance w1 and w2 from the lower web 24 and a distance h from each other. These distances are in each case preferably at least 5 mm, more preferably at least 10 mm and particularly preferably at least 15 mm, wherein the distance can vary along the directrix of the webs and preferably increases from the central region 18 in the direction towards the edge regions 16*a* and 16*b*.

Figure 3A:
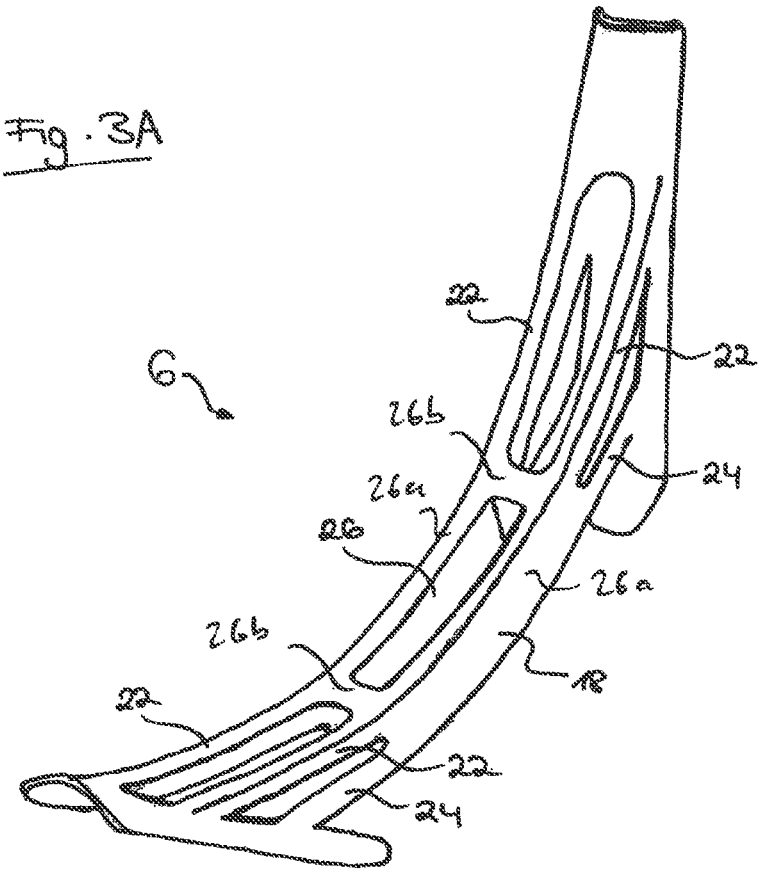
FIG. 3A shows a schematic perspective view of a bridge according to the invention in accordance with a further preferred embodiment.
Figure 3B:
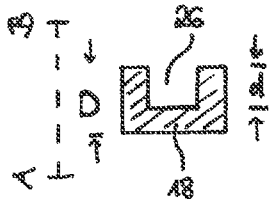
FIG. 3B shows a schematic view of a cross-section of the bridge of FIG. 3A through the line A-B according to FIG. 1.

FIG. 3A shows a further preferred embodiment of a bridge 6 for a frame 2 according to the invention, in which also the central region 18 is groove-shaped. FIG. 3B shows a cross-section of the bridge of FIG. 3A through the line A-B according to FIG. 1. Thus, the bridge of FIG. 3A has a groove-shaped recess 26 in the central region 18, which has a side that is open towards the string bed but is closed on both sides by means of end walls 26*b*. Together with the two side walls 26*a* of the groove-shaped central region 18, these end walls 26*b* form a pot-shaped structure. The bottom of the grove preferably has at least two through openings or string openings (not shown).

Figure 3C:
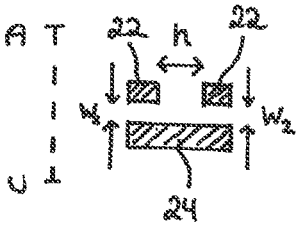
FIG. 3C shows a schematic view of a cross-section of the bridge of FIG. 3A through the line C-D according to FIG. 1.

In view of the cross-sectional profile of the bridge of FIG. 3A through the line C-D according to FIG. 1 as shown in FIG. 3C, the above statements as to FIG. 2C apply analogously.

The extension D of the central region in the longitudinal direction of the racket frame (see FIG. 3B) is, at least in sections, preferably at least 10 mm, more preferably at least 12 mm. The groove depth d is preferably at least 8 mm, more preferably at least 10 mm. It is of course not necessary that the groove-shaped recess 26 has a square cross-section, as indicated in FIG. 3B, but can also be, e.g., rectangular or U-shaped.

Figure 4:
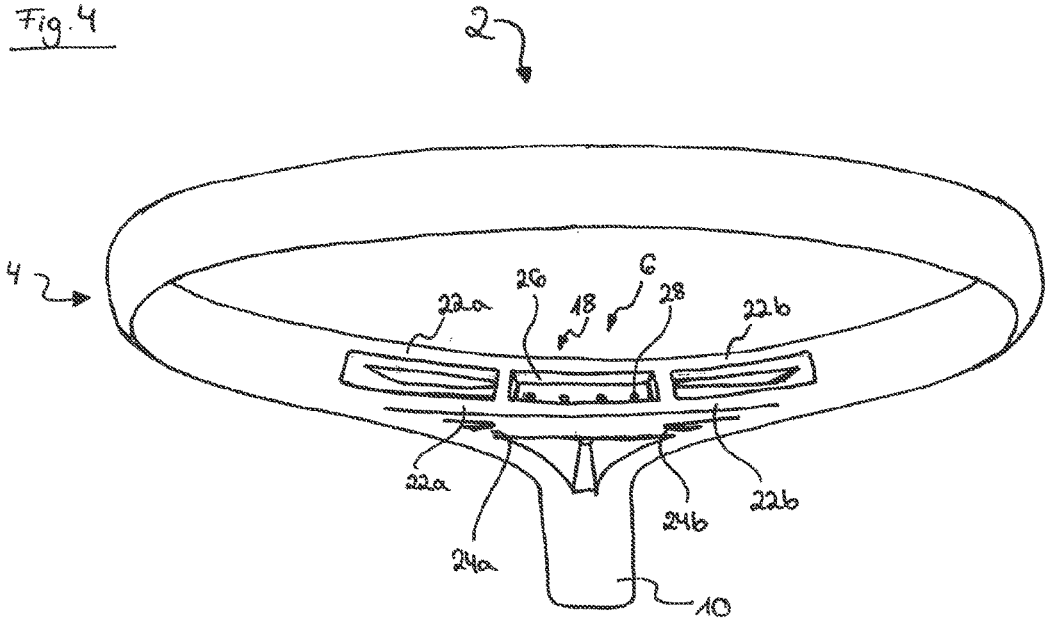
FIG. 4 shows a schematic perspective view of a frame according to the invention in accordance with a further preferred embodiment in a front view seen in an inclined manner from the top.

FIG. 4 shows a schematic perspective view of a frame according to the invention with the bridge according to FIG. 3. The frame comprises a handle region 10 and a head region 4 with bridge 6 in a front view seen in an inclined manner from the top. The central region 18 is in the center of the bridge 6. Two upper webs 22*a*, 22*b* extend from the central region 18 and extend towards the closest bracket, which is not shown here because in the finished racket frame the brackets are preferably incorporated in the carbon fiber composite material of the racket head. The central region 18 has a groove-shaped recess 26 which is open towards the string bed 8. The end sides facing in the direction of sides a and b, as well as the bottom of the groove facing in the direction of the handle region 10, however, are closed, so that the central region 18 can be called pot-shaped. The bottom of the pot-shaped groove 26 has four string openings 28, as specified above, through which corresponding longitudinal strings of the stringing are passed. Instead of four string openings 28, also more (e.g., six or eight) or less (e.g., two or three) string openings can be provided in the bottom of the pot-shaped groove 26.

FIGS. 5A to 5D exemplarily show four further embodiments of the bridge 6 in a schematic front view. The basic structures of the embodiments (i.e., for example, in view of the arrangement of the upper and lower webs 22, 24) correspond to the embodiments of FIG. 2 or 3, but in addition to the features already described in connection with FIGS. 2 and 3, they have a lattice structure 30 in the central region 18. The lattice structure 30 is formed by the mutually dependent shapes of the struts 32 and the gaps 34 and depends, i.a., on the number thereof.

The number of gaps or through openings 34 in FIGS. 5A and 5B is five. In alternative embodiments, the number of gaps 34 can have other values. For example, the embodiment of FIG. 5C shows three gaps 34, while the embodiment of FIG. 5D shows nine gaps 34. However, the number of gaps 34 is preferably at least 2.

In general, the gaps can have many shapes. For example, the gaps 34 can be oval, triangular, quadrangular, convexly or concavely polygonal and/or have an irregular shape, wherein corners can be pointed or rounded.

In a front view, the preferred embodiment of a bridge 6 according to the invention as shown in FIG. 5A has five round gaps 34. The alternative preferred embodiment of a bridge 6 according to the invention as shown in FIG. 5B has, in a front view, five mostly triangular gaps 34, the apexes of which point alternatingly towards the racket head 4 and towards the handle region 10. The gap-triangles can have rounded corners and be oblique, equal-sided and/or equilateral. In the shown embodiment, the apexes of the middle and the two outer gap-triangles point towards the head region 4 and the apexes of the remaining two triangles towards the handle region 10. In alternative embodiments, the directions into which the apexes of the triangles point are the other way round. Alternatively, the triangles can also point in other directions.

A lattice structure according to the invention can have similarly shaped gaps 34 and/or similarly shaped struts 32 and additionally or alternatively non-similarly shaped gaps 34 and/or non-similarly shaped struts. The areas of the gap shapes can remain the same within one embodiment, as shown in FIGS. 5A and 5B, or vary between the gap shapes, as shown in FIG. 5D.

The different lattice structures shown in FIGS. 5A to 5D are only meant to be exemplary and should clarify that the weight of the bridge can be minimized by means of a lattice structure according to the invention in different ways, without affecting the mechanical stability of the bridge. Preferably, accordingly complex and delicate structures can be made from a magnesium alloy in the case the bridge is formed as one part. The use of magnesium provides for the required stability and light-weight construction, whereas the one-part form i.a. guarantees that the shown structures can be made with the required precision without fractures possibly occurring at the joints. Preferably, the shown structures can be made in a casting, particularly preferably injection molding process, so that the finished bridge is made as one single cast or injection molded part.

FIG. 6A schematically shows a perspective section of a further preferred embodiment of a bridge 6 according to the invention. A part of the frame region, with which the bridge is connected by way of the bracket 16, is indicated in dashed lines. The shown bridge section of the bridge 6 of FIG. 6A comprises a bracket 16 and a part of the central region 18. The central region 18 is cut off in the drawing after the longitudinal axis 14. In this embodiment, the bridge 6 has four struts per side a or b, two upper struts 22 and two lower struts 24. FIG. 6B shows a cross-section of the bridge of FIG. 6A through the line A-B according to FIG. 1. FIG. 6B thus shows a cross-section through the central region 18 of the bridge of FIG. 6A. FIG. 6C shows a cross-section of the bridge 6 of FIG. 6A through the line C-D according to FIG. 1. FIG. 6C thus shows a cross-section through the web region of the bridge 6 of FIG. 6A.

The embodiment of FIG. 6A is shown in a front view in FIG. 6D, so that the extension of the strings of the stringing is easily visible. In the embodiment of FIGS. 6A to 6E, none of the webs has a string opening 28. Instead, the longitudinal strings 36 and 37 each extend in a contactless manner between the two upper webs 22 of the corresponding side a or b and between the two lower webs 24 of the corresponding side a or b. The longitudinal strings 36 and 37 each engage with a string opening 28 in the bracket 16 of the corresponding side a or b. This is particularly clearly visible in FIG. 6E which shows an enlarged view of the frame area around side a of the bridge 6 of FIG. 6D. In FIGS. 6D and 6E, the boundaries between the brackets 16 and the adjoining, e.g. carbon-containing frame region are schematically marked by dashed lines. Alternatively or additionally, a string 36 and/or 37 can engage with the frame also outside the brackets and outside the bridge.

FIGS. 6D and 6E show an advantage of the web structure according to the invention: Although the upper webs 22*a*, 22*b* are connected to the racket head 4 by means of the brackets 16*a* and 16*b* relatively close to the top of the racket head 4 and, therefore, provide for a good force transmission from the bridge into the racket head, the length of the longitudinal strings 36 and 37 is not affected disadvantageously by the course of the webs 22*a* and 22*b* because the strings 36 and 37 extend between the upper webs 22*a* and 22*b* and are passed through corresponding string openings 28 in the brackets 16*a* and 16*b* or the remaining racket frame. This is also applicable in the embodiments of FIGS. 1 to 4, in which only one lower web 24*a* is provided and, e.g., the string 37*a* (see FIG. 6E) is passed through a string opening in this single lower web 24*a*.

The embodiments shown in FIGS. 1A to 6E are exemplary and by no means final. All Figures are considered to be schematic illustrations by means of which specific preferred features are to be discussed. Therefore, it is possible that features have been omitted in illustrations of embodiments for reasons of clarity. For example, in FIGS. 2A to 2C, 3A to 3C, 4 and 6A to 6D, the string openings 28 have been omitted completely or partly. This means that features from different illustrations can be combined as far as this is not explicitly excluded.

The invention claimed is:

1. A bridge for a ball game racket, wherein the bridge comprises:

a central region;

two edge regions which are intended for being connected to a frame of a ball game racket, wherein from both sides of the central region, a lower web and two upper webs respectively extend to one of the two edge regions, wherein the central region comprises first through openings for receiving longitudinal strings, and wherein at least two second through openings are arranged for receiving longitudinal strings in such a manner that the longitudinal strings to be received therein each extend between two upper webs; and a third through opening located between the two upper webs and the one lower web, the third through opening extending perpendicularly with respect to a plane defined by the stringing.

2. The bridge according to claim 1, wherein the longitudinal strings to be received by the at least two second through openings each extend in a contactless manner between two upper webs.

3. The bridge according to claim 1, wherein a lower web is not connected to any of the two upper webs positioned on a same side of the central region between the central region and the corresponding edge region.

4. The bridge according to claim 1, wherein two upper webs positioned on a same side of the central region are not connected with each other between the central region and the corresponding edge region.

5. The bridge according to claim 1, wherein a respective distance between two upper webs positioned on a same side of the central region increases from the central region towards the corresponding edge region.

6. The bridge according to claim 1, wherein the cross-sectional area of said third through opening is at least 1.5 $cm^2$.

7. The bridge according to claim 1, wherein the cross-sectional area of said third through opening is at least 2 $cm^2$.

8. The bridge according to claim 1, wherein the cross-sectional area of said third through opening is at least 2.5 $cm^2$.

9. The bridge according to claim 1, wherein the two edge regions each comprise brackets which are suitable for connecting the bridge to a racket frame to be made by using blow tube molding.

10. The bridge according to claim 9, wherein the brackets each have a concave outer surface which is at least 10 $cm^2$.

11. The bridge according to claim 9, wherein the brackets each have a concave outer surface which is at least 15 $cm^2$.

12. The bridge according to claim 9, wherein the brackets each have a concave outer surface which is at least 20 $cm^2$.

13. The bridge according to claim 9, wherein at least one of the second through openings is respectively arranged in a corresponding one of the brackets.

14. The bridge according to claim 9, wherein the brackets each have at least one fourth through opening for receiving longitudinal and/or transverse strings.

15. The bridge according to claim 1, wherein the central region is groove-shaped and wherein the sides of the groove are each configured as a continuous side wall or as a lattice structure.

16. The bridge according to claim 15, wherein the groove has opposing edges from which the webs extend to the edge regions, and wherein the groove is closed at said opposing edges by a respective end wall.

17. The bridge according to claim 15, wherein a bottom of the groove comprises at least two first through openings for receiving longitudinal strings.

18. The bridge according to claim 1, wherein at least one of the second through openings is respectively arranged in a corresponding one of the lower webs.

19. The bridge according to claim 1, wherein from both sides of the central region, two lower webs respectively extend to one of the two edge regions.

20. The bridge according to claim 19, wherein the longitudinal strings to be received by the second through openings each extend between two lower webs.

21. A ball game racket having a racket frame which comprises a handle region, a racket head and a heart region arranged therebetween, the heart region being formed by two frame bars extending from the handle and a bridge according to claim 1.

22. A ball game racket, comprising:

a racket frame which comprises a handle region, a racket head and a heart region arranged therebetween, the heart region being formed by two frame bars extending from the handle region and a bridge, wherein the bridge has a central region and two edge regions being connected to the frame of the ball game racket, wherein from both sides of the central region, a lower web and at least two upper webs respectively extend to the two edge regions, wherein the central region has first through openings for receiving longitudinal strings, wherein at least two second through openings are arranged in the two frame bars for receiving longitudinal strings in such a manner that the longitudinal strings to be received therein each extend between two upper webs, and the bridge includes a third through opening formed between the two upper webs and the one lower web, the third through opening extending perpendicularly with respect to a plane defined by the stringing.

23. A bridge for a ball game racket, wherein the bridge comprises:

a central region and two edge regions which are intended for being connected to a frame of a ball game racket, wherein from both sides of the central region, a lower web and two upper webs respectively extend to the two edge regions, wherein the central region comprises first through openings for receiving longitudinal strings, wherein at least two second through openings are arranged for receiving longitudinal strings in such a manner that the longitudinal strings to be received therein each extend between two upper webs, and wherein the two edge regions each comprise brackets which are suitable for connecting the bridge to a racket frame to be made by using blow tube molding.

* * * * *